United States Patent [19]

Zitzen

[11] Patent Number: 4,557,431

[45] Date of Patent: Dec. 10, 1985

[54] CONTROLLABLE AND ADJUSTABLE YARN TENSIONING DEVICE

[75] Inventor: Wilhelm Zitzen, Monchen-Gladbach, Fed. Rep. of Germany

[73] Assignee: W. Schlafhorst & Co., Monchen-Gladbach, Fed. Rep. of Germany

[21] Appl. No.: 585,980

[22] Filed: Mar. 5, 1984

[30] Foreign Application Priority Data

Aug. 17, 1983 [DE] Fed. Rep. of Germany ..... 3329644
Aug. 17, 1983 [DE] Fed. Rep. of Germany ..... 3329645

[51] Int. Cl.[4] ..... B65H 59/24
[52] U.S. Cl. ..... 242/150 R
[58] Field of Search ..... 242/150 R, 149, 147 R, 242/129.8, 131, 131.1

[56] References Cited

U.S. PATENT DOCUMENTS

| | | | |
|---|---|---|---|
| 3,459,389 | 8/1969 | Wildi et al. | 242/150 R |
| 4,175,718 | 11/1979 | Derichs et al. | 242/150 R |
| 4,202,511 | 5/1980 | Koslowski | 242/150 R |
| 4,272,038 | 6/1981 | Wildi | 242/150 R |
| 4,398,681 | 8/1983 | Kupper | 242/150 R |

FOREIGN PATENT DOCUMENTS

| | | | |
|---|---|---|---|
| 876969 | 5/1953 | Fed. Rep. of Germany | 242/150 R |

*Primary Examiner*—Stanley N. Gilreath
*Attorney, Agent, or Firm*—Herbert L. Lerner; Laurence A. Greenberg

[57] ABSTRACT

A controllable and adjustable yarn tensioner having two rotationally driven brake plates, between which yarn to be placed in tension is guided, includes first and second rotationally supported shafts, one of the brake plates being disposed at one end of the first shaft, the other end of the first shaft having an operative connection with a driving device; the other of the brake plates being disposed at one end of the second shaft, the other end of the first shaft being also connected, via a transmission system disposed outside of the brake plates to the other end of the second shaft, the first shaft being axially slideable; and a brake plate-disengagement device connected to the first shaft; at least one of the two brake plates being connected to an adjustable compression element contributorily determining the braking force at which the brake plates are applied; the first and the second shafts having respective rotational axes spaced from and parallel to one another.

8 Claims, 3 Drawing Figures

CONTROLLABLE AND ADJUSTABLE YARN TENSIONING DEVICE

Figure 1:
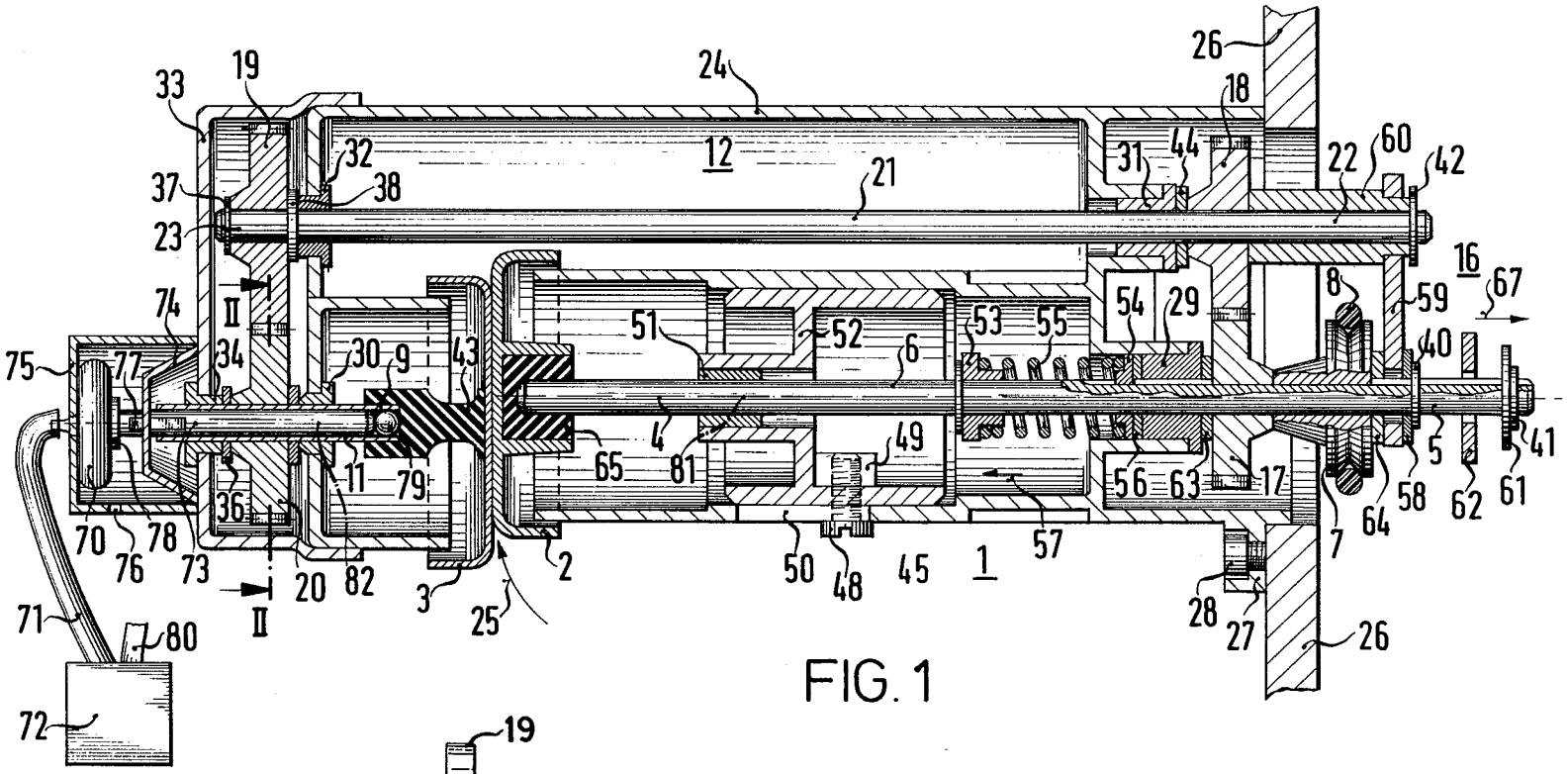

The invention relates to a controllable and adjustable yarn tensioner having two rotatingly driven brake plates between which yarn which is to be tensioned is guided.

In yarn tensioners of this general type, a central shaft is usually provided which extends through both brake plates, and serves simultaneously as a so-called rope friction brake for the yarn.

A disadvantage of such a construction is that the fibers and the threads can wind themselves around the shaft and, if the shaft or its covering serve also as a rope friction brake, they become notched or grooved by the thread and, in the course of time, are rendered useless. Even before that occurs, the brake values vary slowly and insidiously, with consequent disadvantageous effects upon the tension of the yarn.

It is accordingly an object of the invention to provide an universally applicable yarn tensioning device or tensioner which avoids the foregoing disadvantages of heretofore known devices of this general type and wherein, more particularly, the problem of wearing of the parts which are in contact with the thread or yarn is optimally solved.

In a co-pending application Ser. No. 585,971 filed simultaneously with the instant application and of which applicant is a co-inventor, there is described a controllable and adjustable yarn tensioner having two rotationally driven brake plates, between which yarn to be placed in tension is guided, the yarn tensioner further including first and second rotationally supported shafts, one of the brake plates being disposed at one end of the first shaft, the other end of the first shaft having an operative connection with a driving device, the other of the brake plates being disposed at one end of the second shaft, the other end of the first shaft being also connected via a transmission system disposed outside of the brake plates, to the other end of the second shaft, the first shaft being axially slidable, and a brake plate-disengagement device connected to the first shaft, at least one of the two brake plates being connected to an adjustable compression element contributorily determining the braking force at which the brake plates are applied.

This provides the prerequisites for maintaining constant thread tension in a winding machine over long operation periods. The yarn tensioner can be adjusted in a relatively simple manner with respect to the braking force, and adapted to the respective winding conditions with regard to the rotation of the brake plates.

Conversion to different yarn dimensions, a different yarn material, a different yarn property and another winding speed cause no basic difficulties. Because the brake plates have no central openings and no rotating parts extending through these openings, neither the threads nor parts thereof can wind themselves around a rotating shaft or the like.

During operation of the yarn tensioning device, sporadic decreases in the yarn tension can occur. It is accordingly an object of the invention to provide a yarn tensioning device which avoids this disadvantage and provides the prerequisites for avoiding unduly large decreases in the yarn tension.

Furthermore, if several such yarn tensioners operate in parallel, difficulties arise. Adjustment of the braking force is costly and, in order to vary the braking force, each individual yarn tensioner must itself be newly adjusted. It is accordingly another object of the invention to provide a yarn tensioner which, when connected in parallel with one or more additional yarn tensioners, affords a suitable adjustability of the braking force therein in a relatively simple, accurate and operationally reliable manner.

With the foregoing and other objects in view, there is provided, in accordance with the invention, a yarn tensioner of the foregoing general type wherein the first and the second shafts have respective rotational axes which are spaced from and parallel to one another. The two brake plates are thereby offset or mutually staggered a distance which is up to 7 mm in practice. Such an offset is sufficient for producing the desired effects. Heretofore, both shafts were in mutual alignment so that there was no mutual staggering of the brake plates.

In accordance with another aspect of the invention, the yarn tensioner, either with aligned or parallel offset shafts and brake plates, has as its adjustable compression element an air-filled bellows connected to a central controllable pressure-maintenance device. For the purpose of varying the braking force, the air pressure in the existing pres- sure-maintenance device is simply changed centrally for several or many yarn tensioning devices.

In accordance with another feature of the invention and in order to permit the disposition of the bellows at the end thereof located opposite the driving device for the yarn tensioner the one of the first and second brake plates is axially displaceably mounted and is operatively connected with the bellows.

In order to effect this operative connection and, in accordance with another feature of the invention, the second shaft connected to the second brake plate is a hollow shaft, and the yarn tensioner also includes a plunger received in the hollow interior of the second shaft and forming an operative connection between the bellows and the second brake plate.

In accordance with a further feature of the invention and in order to keep the plunger stationary relative to the bellows because relative motion thereof at this location would otherwise disturb the force transmission, the plunger is connected to a device for preventing rotation thereof. The hollow shaft then rotates over the plunger without the latter per se having to be the bearing for the hollow shaft.

In accordance with an added feature of the invention, although the type of bellows is basically optional, a very thin-walled bellows, which does not transmit any noticeable forces at all to the plunger because of movements of the wall thereof or stiffness of the wall thereof is desirable.

Consequently, in accordance with an additional feature of the invention, the plunger has a bearing surface of given size at one end thereof in contact with the bellows, the plunger being connected at the other end thereof to the second brake plate. The size of the bearing surface is, in this case, determinative of the force effect upon the brake plates.

In order to provide a force transmission which is as free of friction as possible, in accordance with a concomitant feature of the invention, the yarn tensioner includes a rotary element connected to the second brake plate, the plunger being, at the other end thereof, in contact with a ball engaging the rotary element. The ball provides the prerequisite that either between the plunger and the ball or between the ball and the rotary element or even at both locations, point-like contacts occur which are especially free of friction and yet can transmit the required forces without disadvantageous effects.

Other features which are considered as characteristic for the invention are set forth in the appended claims.

Although the invention is illustrated and described herein as embodied in a controllable and adjustable yarn tensioner, it is nevertheless not intended to be limited to the details shown, since various modifications and structural changes may be made therein without departing from the spirit of the invention and within the scope and range of equivalents of the claims.

Figure 2:
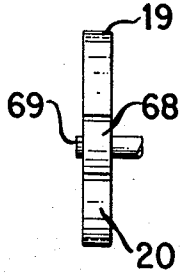

The construction and method of operation of the invention, however, together with additional objects and advantages thereof will be best understood from the following description of specific embodiments when read in connection with the accompanying drawings, in which:

FIG. 1 is a diagrammatic longitudinal sectional view of the yarn tensioner according to the invention; FIG. 2 is a fragmentary view of FIG. 1 showing an alternative arrangement of the transmission or gearing thereof; and FIG. 3 is a view like that of FIG. 1 showing another embodiment of the invention.

Figure 3:
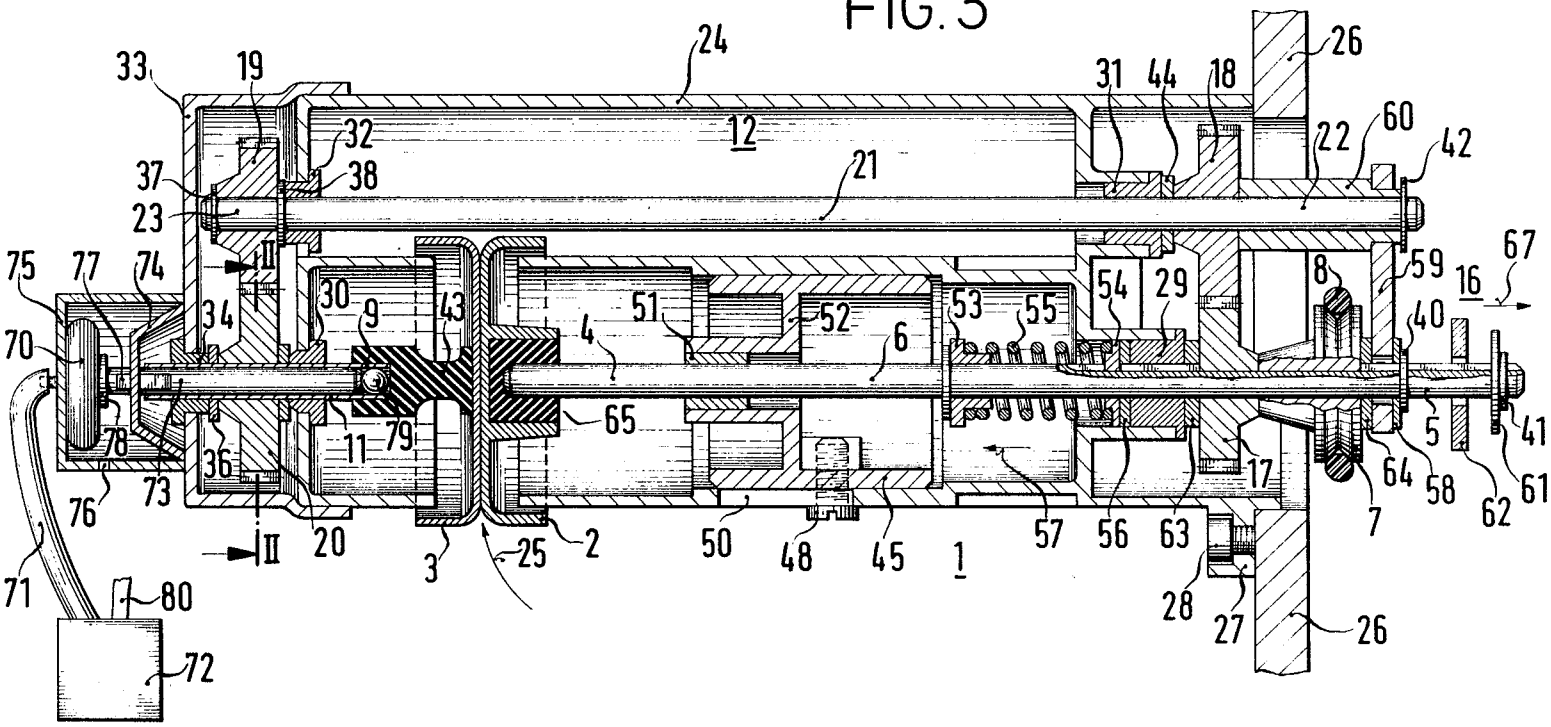

Referring now to the drawing and first, particularly, to FIGS. 1 and 3 thereof, there is shown a yarn tensioning device 1 having a first brake plate 2 and a second brake plate 3. The first brake plate 2 is disposed at an end 4 of a rotatingly mounted first shaft 6. The other end 5 of the first shaft 6 has a drive connection formed of a pulley 7 and driving means such as a belt 8 to an otherwise non-illustrated driving device, such as a small drive motor, for example.

The second brake plate 3 is disposed at a first end 9 of a second rotatingly mounted shaft 11 which is constructed as a hollow shaft.

As shown in FIG. 1, the rotational axis 82 of the second shaft 11 extends parallel to and spaced from the rotational axis 81 of the first shaft 6. A clearly visible mutual offset or staggering of both brake plates 2 and 3 is thereby produced. In the embodiment of FIG. 3, however, both shafts 6 and 11 are arranged serially i. e. behind one another, along the same axis of rotation, and are thus in alignment.

The drive-side end 5 of the first shaft 6 is connected to the second shaft 11 by a transmission 12 arranged outside the brake plates 2 and 3. The first shaft 6 is mounted so as to be slidable axially and is connected to a brake-plate disengaging device 16.

The transmission 12 is in the form of a gear transmission. The gear transmission 12 has, as a drive gear, a first gear 17 arranged so as to be slidable at the drive side end 5 of the first shaft 6 but fixed against rotation thereat, the first gear 17 meshing with a second gear 18 mounted on a third shaft 21. The shaft 21 is disposed and rotatably mounted parallel to the first and second shafts 6 and 11 at a spaced distance from the brake plates 2 and 3. The second gear 18 sits at the first end 22 of the shaft 21. The shaft 21, at the other end 23 thereof, carries a third gear 19 which meshes with a fourth gear 20 disposed at the rear end of the second shaft 11. The gear 20 is fixed against rotation yet axially slidable in relation to the second shaft 11, as shown in FIG. 2.

The yarn tensioner 1 is disposed in a housing 24 shown in section. The housing 24 surrounds the transmission 12, the shafts 6, 11 and 21, and is formed with an open gap 25 for inserting the yarn between the brake plates 2 and 3. At the drive side of the yarn tensioner, the housing 24 is fastened to a carrier element 26 in an overhung or cantilever position. The carrier element 26 may, for example, be the housing of a cross-wound coil or cheese winding device. For secure fastening, the housing 24 is provided with two or three mounting legs 27, one of which is visible in FIGS. 1 and 3. To effect the fastening, screws 28 are provided.

The housing 24 also carries bearings for the shafts, in particular, a bearing 29 for the first shaft 6, a bearing 30 for the second shaft 11 and bearings 31 and 32 for the third shaft 21.

A removable cover 33 is located at the end of the housing 24 facing away from the fastening locations 27. The cover 33 covers the gears 19 and 20 of the transmission 12. The cover 33 also carries a bearing 34 for the second shaft 11.

Both gears 19 and 20 may be readily exchanged. For this purpose, the cover 33 is then pulled off from the housing 24 with the simultaneous withdrawal also of the bearing 34 from the shaft 11. After removal of another retainer ring 36 from the shaft 11, the gear 20 can be withdrawn from the shaft 11. After a shaft retainer ring 37 is removed from the shaft 21, the gear 19 can also be taken off.

A sleeve 45 is supported in the housing 24. The sleeve 45 has an adjusting screw 48, which reaches with part of the thread into a recess 49 next to the inner wall of the sleeve 45. The head of the adjustment screw 48 projects through and beyond a slot 50 in the housing 24. A flange 52 supports a bearing 51, which, in turn supports the first shaft 6.

FIGS. 1 and 3 show the brake plate 3 cemented to an intermediate member 43 made of rubber, which forms a connection with the end 9 of the shaft 11. The position of the shaft 21 is secured by a retainer ring 38 which abuts from the outside against the bearing 32, and a retainer ring 44 which abuts from the outside against the bearing 31.

The first shaft 6 has a device for fixing the axial position thereof. This device is formed of a first spring plate 53 which is non-rotatably connected to the first shaft 6, a compression spring 55 being pressed against the spring plate 53 and also bearing against a second spring plate 54 which is connected slidably to but fixed against relative rotation with the first shaft 6. The spring plate 54, through the intermediary of the slide ring 56, bears against a stationary surface provided by the bearing 29. The pre-tensioned compression spring 55 is constrained to shift the first shaft 6 in direction of arrow 57. However, the path over which the shift occurs is limited by a disc in the form of a retainer ring 40 which bears, via a sliding or slip ring 58, against a stationary surface formed by a lug 59. The lug 59 is seated on a sleeve 60 which is freely rotatably stuck onto the end 22 of the third shaft 21, and secured by a retainer ring 42. The sleeve 60 is stationary relative to the rotary movement of the shaft 21, because the lug 59 is slipped onto the first shaft 6, as shown in FIGS. 1 and 3.

A brake plate disengagement device is arranged at the drive-side end 5 of the first shaft 6. It is formed of a disc 61 located at the end 5 of the shaft, and a fork 62 engageable with the disc 61, and, thereby, also sliding the shaft 6 axially against the force of the spring 55 and, thereby, also lifting the brake plate 2 away from the brake plate 3. The disc 61 is secured by a retaining ring 41 against falling off from the shaft 6.

FIG. 1 shows that the gear 17 as well as the pulley 7 are mounted on the shaft 6 slidably yet fixed against rotation relative thereto. Spacer rings or washers 63 and 64 prevent the pulley 7 and the gear 17 axially following or moving together with the first shaft 6.

At all locations at which parts are mounted on the first shaft 6 so as to be fixed against rotation relative thereto yet axially slidable, the shaft 6 is provided with a flat and the respective parts have a projection which fits onto the flat, as shown in FIG. 1. The brake plate 2 is entrained by the shaft 6 through the intermediary of a rubber-elastic insert 65.

The second brake plate is mounted so as to be axially slidable in common with the hollow shaft 11 and has an operative connection with an adjustable compression element in the form of a air-filled bellows 70 which determines the braking force. The bellows 70 is connected via a line 71 to a central, controllable pressure-maintenance device 72.

The operative connection between the bellows 70 and the brake plate 3 is effected by a plunger 73 which is mounted in the hollow shaft 11 so as to be axially slidable, and is connected to a device 74 for preventing rotation thereof. The device 74 is formed of a key-like disc which is pressed into a housing 75 which also serves as a protective housing for the bellows 70. The housing 75 has a constant connection with ambient air via an air bleed-hole 76. The device 74 has a central slot which engages forklike over flats 77 formed in the plunger 73 which otherwise has a circular cross section. At the left-hand end of the plunger 73, as viewed in FIGS. 1 and 3, a circular bearing surface 78 of given size is provided thereon, which engages the bellows 70. At the right hand end of the plunger 73, also as viewed in FIGS. 1 and 3, the plunger 73 is in contact with a ball or sphere 79 which engages a rotary element, namely an intermediate member 43, which is connected with the second brake plate 3.

As shown in FIGS. 1 and 3 other lines 80 extend from the pressure-maintenance device 72 and lead to other yarn tensioners operating in parallel with the yarn tensioner 1. They are, for example, parallel operating yarn tensioners of a winding machine having a plurality of winding stations.

During operation, the first shaft 6 rotates continuously. The first brake plate 2 is directly driven by the shaft 6. The fork 62 is displaced in direction of the arrow 67 in order to open the yarn tensioner. After contact with the disc 61, it entrains the entire shaft 6 in direction of the arrow 67, thereby lifting the brake plate 2 away from the brake plate 3. It is sufficient for the brake plate 2 to be lifted only a few millimeters away from the brake plate 3. The displacement or movement of the fork 62 may be effected by a conventional disengagement mechanism which is otherwise not illustrated in the drawing.

The invention thus offers the possibility for an exact adaptation for or accommodation to different yarn-handling conditions. The yarn tensioner is primarily provided for use in coil winding machines and for parallel operation with like yarn tensioners. The invention is not limited, however, to the illustrated and described embodiment used as an example.

I claim:

1. Controllable and adjustable yarn tensioner having first and second rotationally driven brake plates, between which yarn to be placed in tension is guided, comprising first and second rotationally supported shafts, the first of the brake plates being disposed transversely and rigidly attached to one end of said first shaft, a driving device operatively connected with the other end of said first shaft; the second of the brake plates being disposed transversely and rigidly attached to one end of said second shaft; a transmission system disposed outside of said brake plates for connecting the other end of said first shaft to the other end of said second shaft; and a brake plate-disengagement device connected to said first shaft for slidably moving said first shaft for disengagement of said first brake plate with said second brake plate; at least one of the two brake plates being connected to an adjustable compression element for setting the braking force at which the brake plates are applied; said first and said second shafts having respective rotational axes spaced from and parallel to one another.

2. Yarn tensioner according to claim 1 wherein said compression element comprises an air-filled bellows connected to a central controllable pressure-maintaining device.

3. Controllable and adjustable yarn tensioner having first and second rotationally driven brake plates, between which yarn to be placed in tension is guided, comprising first and second rotationally supported shafts, the first one of the brake plates being disposed transversely and rigidly attached to one end of said first shaft; a driving device operatively connected with the other end of said first shaft; the second one of the brake plates being disposed transversely and rigidly attached to one end of said second shaft; a transmission system disposed outside of the first and second brake plates for connecting the other end of said first shaft to the other end of said second shaft; a brake plate disengagement device connected to said first shaft for slidably moving said first shaft for disengagement of said first brake plate with said second brake plate; an adjustable compression element connected to at least one of said first and second plates for setting the braking force at which the brake plates are applied, said compression element comprising an air-filled bellows connected to a central controllable pressure-maintaining device.

4. Yarn tensioner according to claim 3 wherein the one of the first and second brake plates is axially displaceably mounted and is operatively connected with said bellows.

5. Yarn tensioner according to claim 4 wherein said second shaft connected to the second brake plate is a hollow shaft, and including a plunger received in the hollow interior of said second shaft and forming an operative connection between said bellows and the second brake plate.

6. Yarn tensioner according to claim 5 including a device connected to said plunger for preventing rotation of said plunger.

7. Yarn tensioner according to claim 5 wherein said plunger has a bearing surface of given size at one end thereof in contact with said bellows, said plunger being connected at the other end thereof to the second brake plate.

8. Yarn tensioner according to claim 7 including a rotary element connected with the second brake plate, and wherein said plunger at said other end thereof is in contact with a ball engaging said rotary element.

* * * * *